US006375456B1

(12) United States Patent
Dugue et al.

(10) Patent No.: US 6,375,456 B1
(45) Date of Patent: Apr. 23, 2002

(54) COMBUSTION PROCESS APPLICABLE TO THE MANUFACTURE OF CEMENT

(75) Inventors: Jacques Dugue; Ovidiu Marin; Thierry Borissoff; Dora Sophia Alves; Michel Viardot, all of Paris Cedex (FR)

(73) Assignee: L'Air Liquide Societe Anonyme pour l'Etude et l'Exploitation des Procedes Georges Claude, Paris Cedex (FR)

( * ) Notice: Subject to any disclaimer, the term of this patent is extended or adjusted under 35 U.S.C. 154(b) by 0 days.

(21) Appl. No.: 09/599,215

(22) Filed: Jun. 22, 2000

(30) Foreign Application Priority Data

Jul. 2, 1999 (FR) ..... 99 08562

(51) Int. Cl.[7] ..... F27B 15/10
(52) U.S. Cl. ..... 432/1; 432/14; 432/105
(58) Field of Search ..... 432/1, 14, 105, 432/106

(56) References Cited

U.S. PATENT DOCUMENTS 3,302,938 A 2/1967 Bendy
3,404,199 A 10/1968 Hoffmann
3,890,084 A * 6/1975 Voorheis et al. ..... 431/10
3,925,091 A 12/1975 Yoshida et al.
5,007,823 A 4/1991 Mayotte et al.
5,572,938 A 11/1996 Leger
5,580,237 A 12/1996 Leger

OTHER PUBLICATIONS

U.S. application No. 09/468,110, Robillard et al., filed Dec. 21, 1999; Injector for a Burner and Corresponding Injection System.

* cited by examiner

*Primary Examiner*—Jiping Lu
(74) *Attorney, Agent, or Firm*—Burns, Doane, Swecker & Mathis, L.L.P.

(57) ABSTRACT

Combustion process especially applicable to cement works, in which process it is desired to use fuels which are difficult to ignite. To do so, a flame comprising a primary zone and a secondary zone is created. The hot primary zone is created using an oxy-fuel flame, which makes it possible to preheat the fuel which is difficult to ignite so as to raise it to the suitable temperature in the secondary zone where it burns, with air, in order to create the main flame. Applications: cement, metallurgy, glass, etc.

54 Claims, 5 Drawing Sheets

COMBUSTION PROCESS APPLICABLE TO THE MANUFACTURE OF CEMENT

BACKGROUND OF THE INVENTION

1. Field of the Invention

Figure 1:
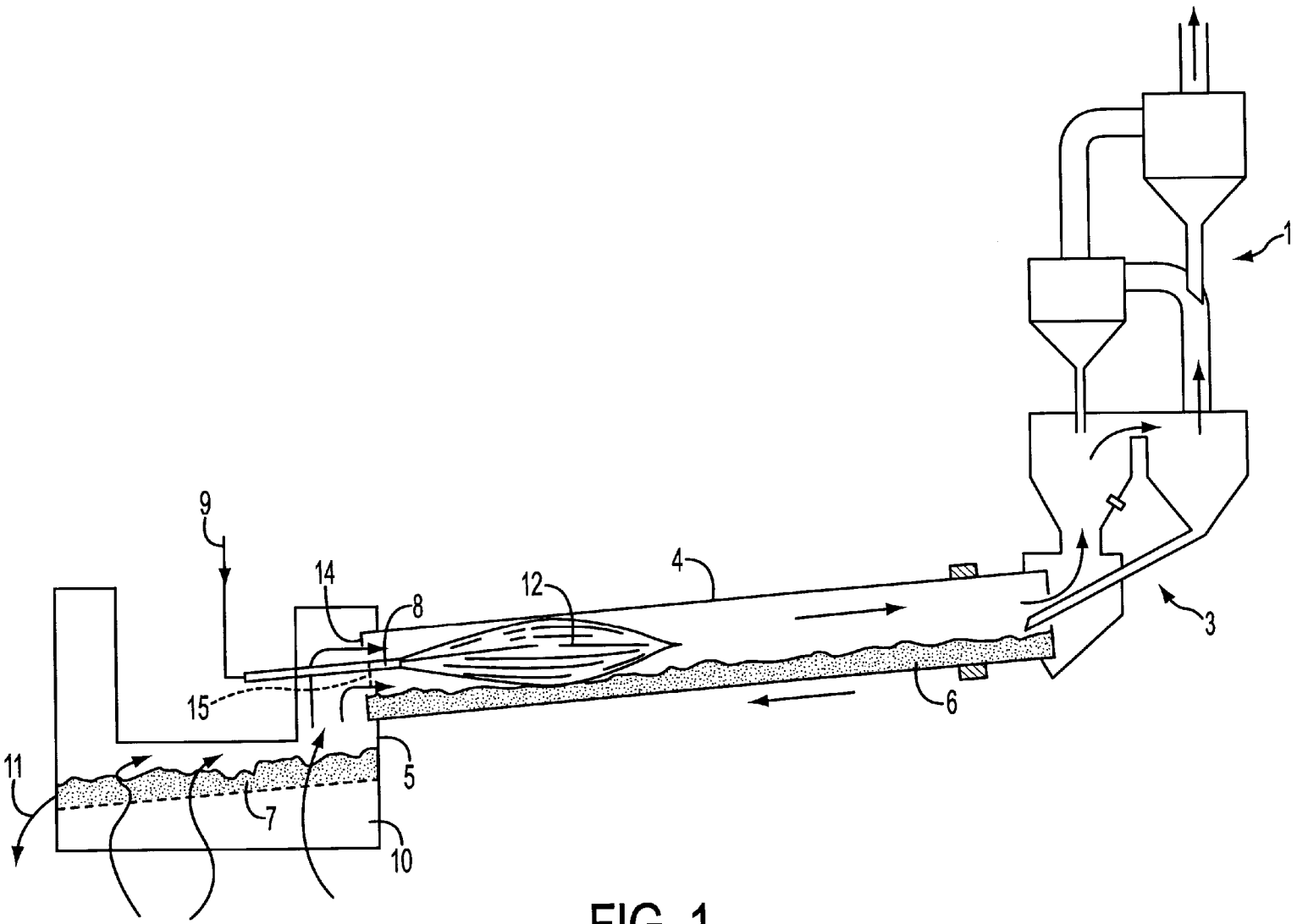
FIG. 1 (PRIOR ART)

The present invention relates to a combustion process, applicable more particularly to the calcining of an ore-based material, especially to the manufacture of cement, in which process a material is heated in contact with a heat source essentially created by a flame produced by at least one fuel and at least one oxidizer. This calcining process is integrated into a cement preparation process. The invention also relates to the use of the combustion process to heat a charge, whether for melting a metal, for maintaining it at temperature, for the destruction of waste, etc.

2. Description of the Related Art

The manufacture of cement involves the manufacture of an intermediate product called "clinker". The clinker is a product which is obtained by firing an ore-based material, especially clay and limestone. The material in powder form may be delivered to a rotary kiln either in dry form (dry process) or in the form of a water-based slurry (wet process). The composition of the clinker is in general carefully controlled so as to obtain the desired proportions of the various ore materials and especially calcium carbonate, silica, alumina, iron oxide and magnesium carbonate. After the kiln has been charged, the precursor material for the manufacture of clinker firstly undergoes a drying step and a heating step. Next, this material undergoes a calcining step in which the carbonates of the various ores are converted to the oxide of these ores by removal of carbon dioxide. Since the temperatures are still high, the ores thus obtained react together chemically to essentially produce calcium silicates and calcium aluminates. The latter process is also called "clinkering" and is carried out in the hot zone of a rotary kiln. The resulting clinker is then cooled and pulverized, and then mixed with additional ingredients in order to form a cement such as Portland-type cement.

The processes for manufacturing cements have many similarities and the essential differences between these various processes reside essentially in the method used for drying, preheating or calcining the clinker precursor. As a general rule in all these systems, the clinker manufacturing process is largely the same, that is to say a process in which a rotary kiln is used, the clinker precursors move down along the kiln under gravity while the hot gases are circulated as a countercurrent from a zone in which combustion has been carried out.

It is known, for example from U.S. Pat. No. 5,572,938, that the use of oxygen in rotary kilns for clinker manufacture make it possible to increase the production of clinker by essentially improving the combustion usually carried out using combustion in air. However, until now these techniques have not been very well controlled and often represent a substantial increase in the production costs for the manufacturer.

Various cement manufacturing techniques are described, especially in patents U.S. Pat. Nos. 3,302,938, 3,404,199 and 3,925,091, the descriptions of which are incorporated into the present application by reference.

Other processes in which oxygen is also used in the manufacture of cement are described in patents U.S. Pat. Nos. 5,007,823 and 5,580,237.

In general, clinker manufacturers try to incorporate into their kiln, as fuels, so as to reduce the production costs, fuels which have the property of burning relatively poorly, as well as products of low combustibility which have a low net calorific value (NCV). In general, they seek to use all kinds of waste of relatively low combustibility for which they may especially receive premiums for the destruction of said waste. In fact, the clinker manufacturing process consumes a great deal of energy, particularly because the reaction of decarbonizing the calcium carbonate in the clinker manufacturing operation is a very endothermic reaction and therefore consumes a great deal of energy. p The usual fuels which burn easily in rotary kilns for clinker manufacture are coal, heavy fuel oils and natural gas. These fuels have a net calorific value (NCV) with a value of between 30 and $45\times10^6$ joules/kg. The heavy fuel oils may be preheated and atomized into droplets having a size of less than 200 microns with a fraction of their mass converted into droplets having a diameter of less than 50 microns. The smallest droplets rapidly evaporate and thus allow the flame to be ignited close to the end of the burner.

In the same way, the coal particles are pulverized with a size distribution of between 10 and 200 microns. The rapid and stable ignition of the combustion is improved by controlling the size but also by the combustible volatile material released by the particles when they are heated. However, cement manufacturers continue to make efforts to reduce the cost of the fuels used in the production of clinker and at the present time try especially to burn liquid or solid waste of low combustibilities and a net calorific value (NCV) often less than $15\times10^6$ joules/kg. However, these poor fuels often have a water content of greater than 20% by mass, or a large particle size (for example 75% of the mass consisting of particles or droplets having a size of greater than 200 microns).

The use of these fuels which are difficult to burn leads to a number of problems in the combustion zone and in particular in the calcining zone of the rotary kilns used for manufacturing clinker, and especially unstable ignition of the flame and excessively low degrees of combustion, thereby generating uncontrolled concentrations of carbon monoxide, emissions of hydrocarbons into the gases emanating from these kilns and unacceptable levels of unburned material in the ash, particularly unburned material in the gases emanating from the kiln, with consequently reductions in productivity, unless additional amounts of fuel are added so as to compensate for the deleterious effects of these poor fuels.

A SUMMARY OF THE INVENTION

The problem at the basis of the invention stems from the observation by the inventors that the fuel injected into the kiln and especially the fuels having a low net calorific value were unable to contribute to the combustion before having traveled rather a long distance inside the rotary kiln. If the distance traveled in the kiln is too short, the combustion is of poor quality.

The combustion process according to the invention is distinguished in that the flame comprises a primary combustion zone created by the combustion of a first fuel and of a first oxidizer, this primary zone being located near the points of injection of the first oxidizer and of the first fuel, as well as a secondary combustion zone located downstream of the primary zone, for the combustion of a second fuel and of a second oxidizer, the second fuel being preheated by flowing through or near the primary zone of the flame.

Preferably, the distance that the second fuel flows in contact with the flame of the primary zone will be sufficient for at least. some of the second fuel to have been preheated to a temperature of at least approximately 400° C. preferably approximately 600° C. and even more preferably 800° C.

According to a preferred mode of implementing the invention, it has been found that when the distance that the second fuel flows in contact with the flame was covered under conditions such that the temperature of this second fuel was substantially about 1000° C. at least when the latter arrived in the second combustion zone, the combustion of the second fuel in this second zone was carried out properly, resulting in a reduction in the NOx content and in the amount of unburned material in the smoke.

Preferably, the secondary fuel will be a fuel whose net calorific value (NCV) will be less that $15\times10^6$ joules/kg. According to one embodiment of the invention, the secondary fuel may be a fuel whose water content by mass will be greater than or equal to approximately 20% and less than or equal to approximately 95%, preferably less than or equal to 70%. According to another embodiment, the secondary fuel will contain ash in a mass proportion of greater than 20%.

Of course, according to the invention, it is possible to use a secondary fuel or a mixture of secondary fuels (chosen especially from those mentioned above) as well as a mixture of one or more of these secondary fuels with another fuel such as the primary fuels mentioned in the context of the present description and especially those having a net calorific value (NCV) greater than $30\times10^6$ joules/kg. According to one mode of implementing the invention, the ignition distance defined as being the distance between the end of injection of the oxidizers and fuels and the start of the combustion zone will be less than 2 m, preferably less than approximately 1 m.

As a general rule, it will be considered that the primary flame zone is largely over when more than approximately 90% of the primary oxidizer has reacted with the primary fuel.

In general, the energy of the primary flame will be as low as possible and will represent at most 30% and Preferably at most 15% of the total energy provided by the flame. Preferably, the energy of the primary flame will represent between approximately 1% and 10% of the total energy provided by the flame, this primary flame preferably comprising a zone with as high as possible a temperature, so as to raise the temperature of the secondary fuel in contact with it as rapidly as possible.

According to another embodiment of the invention, the primary fuel will be a fuel preferably having an NCV of greater than $30\times10^6$ joules/kg, that is to say a fuel which ignites easily. However, it will be possible to mix this high-quality fuel with a fuel having a low net calorific value or a fuel of poor ignitability such as those fuels defined above, in proportions such that, however, a primary flame having the required temperature qualities, and especially having a temperature preferably greater than 800° C. and more preferably greater than 1000° C. is obtained. The primary oxidizer will be an oxidizer which will contain more than 21% oxygen, preferably more than 35% oxygen, more preferably more than 50% oxygen and even more preferably will be industrially pure oxygen, i.e. oxygen comprising more than approximately 88% oxygen by volume, such as the oxygen produced by systems for producing oxygen by adsorption, such as VSA (Vacuum Swing Adsorption) systems, and may also be formed by oxygen of cryogenic quality, i.e. oxygen having a purify often greater than 98%, optionally pure or as a mixture with air.

The secondary fuel has already been described above, whereas the secondary oxidizer will preferably be air, particularly the air which is normally used in the burner fitted into cement kilns (also called primary air and/or secondary air).

A BRIEF DESCRIPTION OF THE FIGURES OF THE DRAWING

Figure 2:
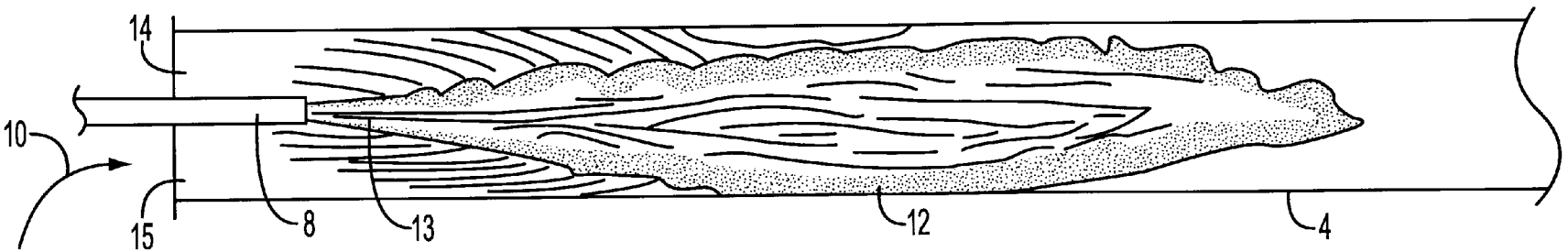
FIG. 2 (PRIOR ART)
Figure 4:
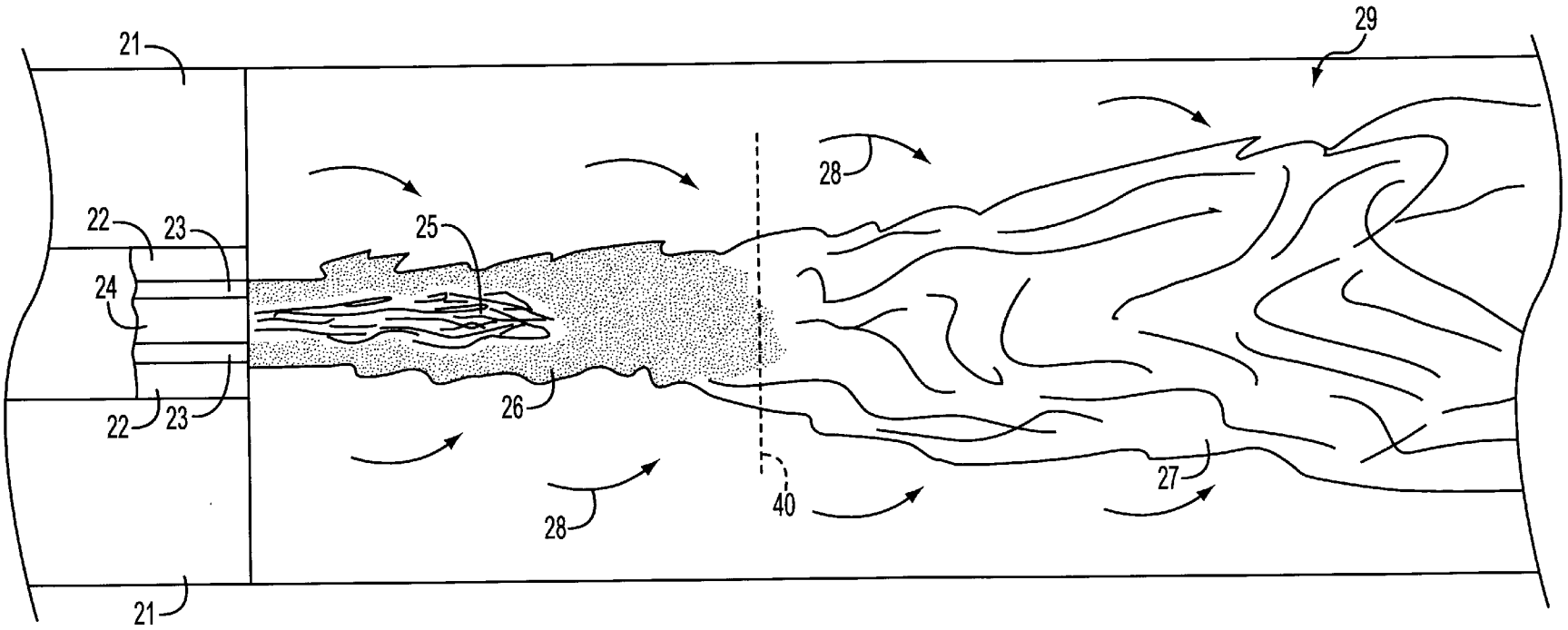
Figure 5:
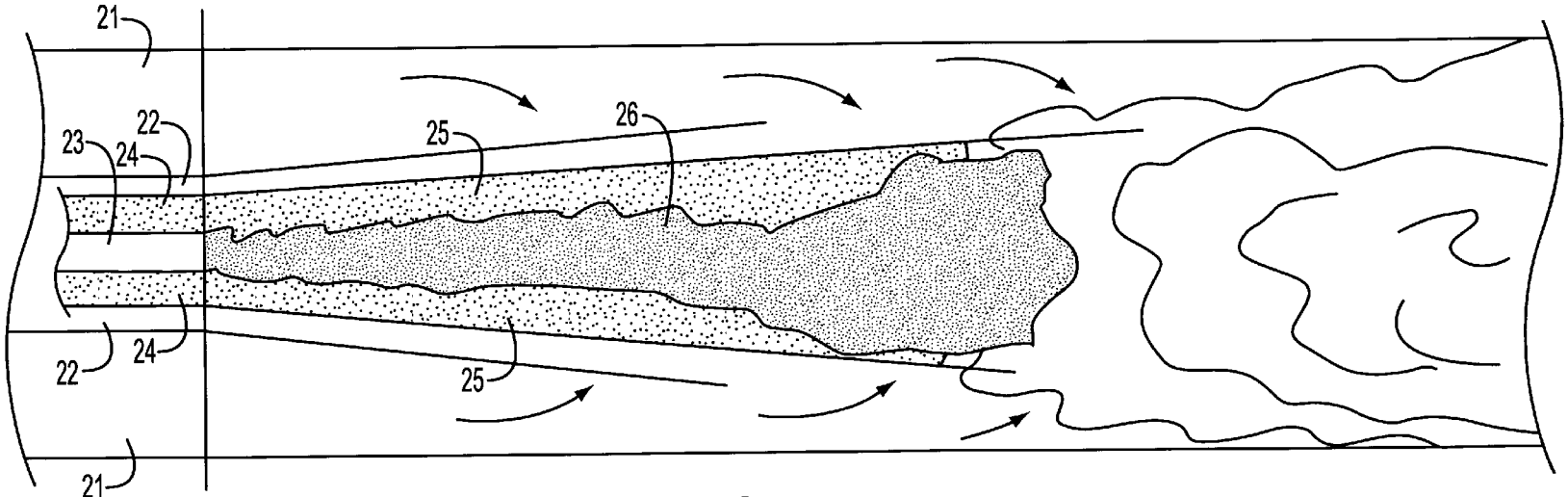
Figure 6:
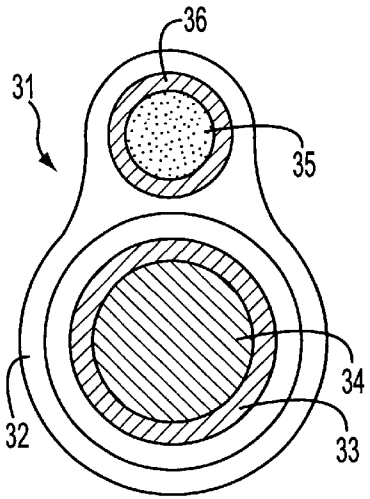

The invention will be more clearly understood with the aid of the following nonlimiting illustrative examples, together with the figures which represent:

FIG. 1, a schematic sectional side view of a plant for manufacturing clinker according to the prior art;

FIG. 2, a detailed view of the flame used in the rotary kiln for the production of clinker according to the prior art;

FIG. 3, shown schematically, a flame for which the ignition distance is regarded as being correct and a degraded flame, i.e. an unacceptable flame;

FIG. 4, a first embodiment of the combustion process according to the invention in which the second fuel is injected into an oxy-fuel flame;

FIG. 5, a secondary embodiment of the invention in which the primary oxygen/fuel flame is sent along the center of the jet of the second fuel;

FIG. 6, a third embodiment of the invention in which the primary oxygen/fuel flame surrounds the second fuel so as to preheat it, the whole being placed above the air/fuel flame existing in the kiln.

A DETAILED DESCRIPTION OF THE PREFERRED EMBODIMENTS

In FIG. 1, the green material coming from zone 1 is sent into the precalcining zone 3 (or, 10 according to a certain embodiment, a Lepol-type exchanger) in which the temperature of the green material progressively rises with the countercurrent of hot gases flowing from the left to the right in the figure.

FIG. 2 shows a detailed view of the flame (12) shown in FIG. 1. In this figure, the same elements as those in the other figures bear the same reference numbers. The flame extends over a great length of the rotary kiln (4) and the beginning of the combustion starts effectively at a certain distance from the end of the burner (8), the noncombustion zone visible between the end of the burner and the beginning of the flame being shown by the zone (13). The primary air and the main fuel are injected into the burner, while the secondary air is injected along the sides (according to the prior art). The primary air is injected at a temperature of approximately 100° C. the secondary air has a temperature often between 500 and 900° C. while the temperature of the flame in its hottest part is at least about 1900° C. The length of the flame in such a rotary kiln is typically from 4 to 7 times the diameter of the rotary kiln (4).

Figure 3A:
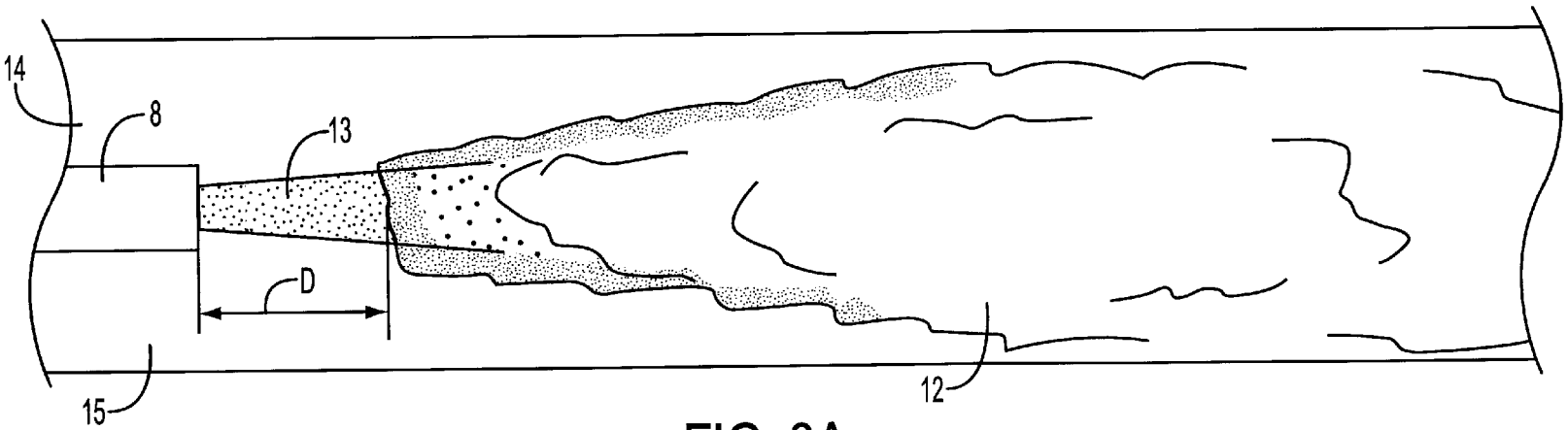
FIG. 3A (PRIOR ART)
Figure 3B:
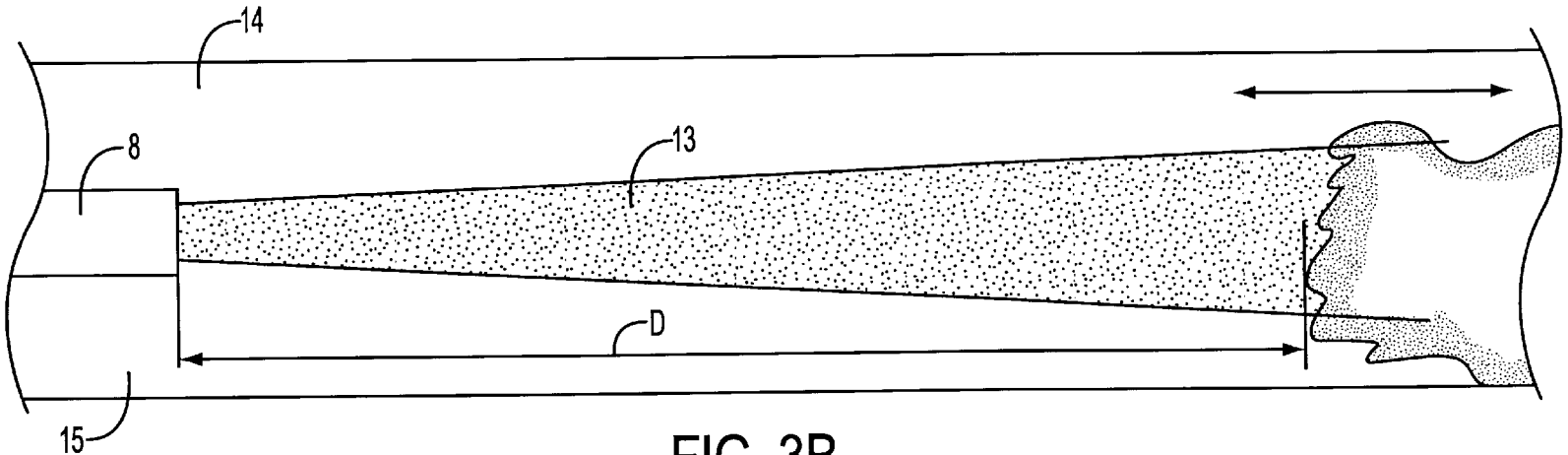
FIG. 3B (PRIOR ART)

FIGS. 3A and 3B show, with the same reference numbers as in the previous figures, the flames of the prior art, in the case in which the ignition distance (D) shown by the zone (13) is correct in order to ensure good combustion, this distance (D) generally being less than 1 meter (FIG. 3A) while shown in FIG. 3B is typically a degraded flame, that is to say the zone. (13) extends over an unacceptable length D which is about 2 to 3 meters or more. Not only is this ignition distance too great but the position of the ignition, that is to say the end of the unignited zone may fluctuate greatly and there is a risk of flame detachment. Typically, the injection of poor-quality fuels into an existing flame of the prior art as described above leads to a degraded flame, as shown in this FIG. 3B, this being unacceptable both from the standpoint of the combustion and from the standpoint of the safety of the plant.

The next FIGS. (4, 5 and 6) show various embodiments of the invention. FIG. 4 shows a first solution according to the invention, in which the hot oxy-fuel flame is located around the jet of secondary fuel of poor quality, that is to say it surrounds the latter. The secondary fuel is injected (at 24), while the oxygen/first fuel mixture is injected around the secondary fuel through the concentric orifice (23) so as to create a flame sufficiently hot to preheat, as was described above, the poor-quality fuel injected through the orifice (24). As shown in the figure, the flame develops with, at the center in the upstream zone of the flame, a zone (25) in which the second fuel is preheated by contact with the generally hot oxy-fuel flame, which develops in the zone (26) around the poor-quality fuel, while a second, downstream combustion zone develops largely beyond the vertical line (40) shown in the figure, generally when approximately more than 90% of the oxidizer, i.e. the oxygen used in the hot flame (26), has already reacted with the first (generally high-quality) fuel to create the hot flame which preheats the second fuel. Downstream of the line (40), there is the second combustion zone of the flame resulting essentially from the combustion of the second (poor-quality) fuel with the surrounding air, i.e. the primary air injected through the annular cavity (22) and/or the so-called secondary air injected through the annular cavity (21), which air, as within the context of the prior art, has generally been preheated to a temperature of between 500 and 1000° C. this preheating taking place in contact with the clinker formed in the rotary kiln, so as to cool the latter using air pumped from the outside at the surrounding temperature. The entire flame (29) therefore has a rear part upstream of the line (40), essentially formed by a short oxy-fuel flame which preheats the second fuel, and a downstream part (27) in which the main combustion according to the invention occurs, of the poor-quality fuel with air, which combustion may be carried out under correct conditions by the preheating, according to the invention, of the poor-quality fuel in the upstream part of the flame.

FIG. 5 shows another embodiment of the invention, in which the flame which heats the poor-quality fuel (25) is injected centrally in the injection system, while the poor-quality fuel to preheated surrounds this oxy-fuel flame injected through the orifice (23). The other elements remain similar to those described in FIG. 4 with the same operating principle, namely, in the upstream zone, preheating of the poor-quality fuel which thus reaches the downstream part generally with a temperature preferably greater than or equal to 1000° C. thereby making it possible to burn quite correctly with the primary and/or secondary air emanating from the annular cavities (22) and/or (21).

According to one characteristic of the invention, the poor-quality second fuel, which must be preheated by the preferably oxygen/first fuel flame, will be injected into the latter or on the outside of the latter at a velocity which will preferably not exceed 50 meters/s and more preferably which will not exceed 20 meters/s. In general, it has been found that the injection velocities of this second fuel to be reheated, which are about 10 meters/s, were particularly suitable when the fuels are fuels having a low NCV or aqueous fuels, such as sludge from purification stations, etc.

Within the context of the present invention, it is not in fact precluded for it to be possible also to inject solid waste in addition to the second fuel, this solid waste, such as carpet waste or plastic waste, generally consisting of relatively coarse pieces and being injected at velocities which, in contrast, are high, for example about 200 meters/s, so as to be thrown as far as possible upstream of the zone for clinkering the clinker and so as then to be able to be pyrolyzed and thus to be associated with the formation of the clinker.

FIG. 6 shows an embodiment of the invention corresponding to a modification of an existing burner in a kiln (32). The entire system (31) comprises, in its lower part, the existing burner (32) and, in its upper part, the assembly added according to the process of the invention. In its lower part, the fuel, which optionally includes waste, especially solid waste, is injected through the orifice (34) pneumatically by means of the primary air, while the secondary air is injected into the annular pipe (33) so as to produce the combustion system according to the prior art. Placed above this combustion system, and more preferably on the same vertical axis, is a combustion system according to the invention in which the second fuel (35) to be preheated is located at the center of a flame injected via the annular cover (36) preferably consisting, as described above, of oxygen and a first fuel so as to preheat this second fuel. This second fuel preferably consists, as indicated above, of a pulverulent or liquid fuel which has to be preheated before being able to react, in the secondary combustion zone of the flame, with the secondary air, especially that which has not reacted with the flame (33–34). The elements of this flame (35–36) encounter the elements of the air/fuel flame by gravity. Of course, here again it is possible, according to one embodiment of the invention, to place the hot flame (36) at the center and the injection of second fuels (35) around this hot flame (36).

What is claimed is:

1. A process for calcining an ore-based material, comprising the steps of:

producing a flame with at least one fuel and at least one oxidizer, the flame comprising a primary combustion zone formed by the combustion of a first fuel and a first oxidizer, the primary combustion zone located adjacent to the points of injection of the first oxidizer and of the first fuel, and a secondary combustion zone formed by the combustion of a second fuel and a second oxidizer, the secondary combustion zone located downstream of the primary zone;

preheating the second fuel by flowing the second fuel through the primary zone of the flame; and heating said material by contact with a heat source created by the flame;

wherein the step of preheating the second fuel comprises flowing the second fuel along a distance with the second fuel in contact with the flame in the primary zone for at least some of the second fuel to be preheated to a temperature of at least 400° C.

2. The process as claimed in claim 1, wherein the step of preheating the second fuel comprises flowing the second fuel along a distance with the second fuel in contact with the flame in the primary zone for at least some of the second fuel to be preheated to a temperature of at least 600° C.

3. The process as claimed in claim 1, wherein the step of preheating the second fuel comprises flowing the second fuel along a distance with the second fuel in contact with the flame in the primary zone for at least some of the second fuel to be preheated to a temperature of at least 1000° C.

4. The process as claimed in claim 1, wherein the step of producing a flame comprises producing a flame with a secondary fuel having a water content greater than or equal to 20% by weight and less than or equal to 95% by weight.

5. The process as claimed in claim 1, wherein the step of producing a flame comprises producing a flame with a secondary fuel containing ash in proportions greater than 20% by weight.

6. The process as claimed in claim 1, wherein the step of preheating the second fuel comprises flowing the second fuel along an ignition distance between a point selected from the group consisting of the point of injection of the oxidizer and the point of injection of the fuel, and the beginning of the secondary flame, the distance being less than 2 meters.

7. The process as claimed in claim 1, wherein the step of preheating the second fuel comprises preheating a secondary fuel comprising several secondary fuels and containing 0% to 50% by volume of fuel identical to the primary fuel.

8. The process as claimed in claim 1, wherein the step of producing a flame comprises producing flame with primary fuel comprising from 0% to 100% by volume of fuel used as secondary fuel.

9. The process as claimed in claim 1, wherein the energy of the primary flame is more than 30% of the total energy provided by the flame.

10. The process as claimed in claim 1, wherein the energy of the primary flame represents between 1% and 10% of the total energy provided by the flame.

11. The process as claimed in claim 1, wherein the primary fuel comprises natural gases.

12. The process as claimed in claim 1, wherein the primary oxidizer comprises oxygen-enriched air having more that 21% oxygen by volume.

13. The process as claimed in claim 12, wherein the primary oxidizer comprises more than 50% oxygen by volume.

14. The process as claimed in claim 13, wherein the primary oxidizer comprises more than 98% oxygen by volume.

15. The process as claimed in claim 12, wherein the primary oxidizer comprises more than 88% oxygen by volume.

16. The process as claimed in claim 1, wherein the secondary oxidizer consists essentially of air.

17. The process as claimed in claim 1, wherein the step of producing a flame comprises producing a flame with a secondary fuel having a net calorific value (NCV) less than or equal to $15\times10^6$ J/kg.

18. The process as claimed in claim 1, wherein the step of producing a flame comprises producing a flame with a secondary fuel having a water content greater than or equal to 20% by weight and less than or equal to 95% by weight.

19. The process as claimed in claim 1, wherein the step of producing a flame comprises producing a flame with a secondary fuel containing ash in proportions greater than 20% by weight.

20. The process as claimed in claim 1, wherein the step of preheating the second fuel comprises flowing the second fuel along an ignition distance between a point selected from the group consisting of the point of injection of the oxidizer and the point of injection of the fuel, and the beginning of the secondary flame, the distance being less than 2 meters.

21. The process as claimed in claim 1, wherein the step of preheating the second fuel comprises preheating a secondary fuel comprising several secondary fuels and containing 0% to 50% by volume of fuel identical to the primary fuel.

22. The process as claimed in claim 1, wherein the step of producing a flame comprises producing flame with primary fuel comprising from 0% to 100% by volume of fuel used as secondary fuel.

23. The process as claimed in claim 1, wherein the step of producing a flame comprises producing a flame with a secondary combustion zone which starts at a distance from the points of injection of the oxidizers and fuels such that 90% by volume of the primary oxidizer has reacted with the primary fuel.

24. The process as claimed in claim 1, wherein the energy of the primary flame is more than 30% of the total energy provided by the flame.

25. The process as claimed in claim 1, wherein the energy of the primary flame represents between 1% and 10% of the total energy provided by the flame.

26. The process as claimed in claim 1, wherein the primary fuel comprises natural gases.

27. The process as claimed in claim 1, wherein the primary oxidizer comprises oxygen-enriched air having more that 21% oxygen by volume.

28. The process as claimed in claim 1, wherein the secondary oxidizer consists essentially of air.

29. The process as claimed in claim 1, wherein the primary oxidizer has an oxygen concentration greater than the oxygen concentration of the secondary oxidizer.

30. The process as claimed in claim 1, wherein the second fuel is injected at a velocity which does not exceed 50 meters/s.

31. The process as claimed in claim 1, wherein the step of preheating the second fuel comprises flowing the second fuel along a distance with the second fuel in contact with the flame in the primary zone for at least some of the second fuel to be preheated to a temperature of at least 800° C.

32. The process as claimed in claim 1, wherein the step of producing a flame comprises producing a flame with a secondary fuel having a water content greater than or equal to 20% by weight and less than or equal to 70% by weight.

33. The process as claimed in claim 1, wherein the step of preheating the second fuel comprises flowing the second fuel along an ignition distance between a point selected from the group consisting of the point of injection of the oxidizer and the point of injection of the fuel, and the beginning of the secondary flame, the distance being less than 1 meter.

34. The process as claimed in claim 1, wherein the energy of the primary flame is more than 15% of the total energy provided by the flame.

35. The process as claimed in claim 2, wherein the step of producing a flame comprises producing a flame with a secondary fuel having a net calorific value (NCV) less than or equal to $15\times10^6$ J/kg.

36. The process as claimed in claim 2, wherein the step of producing a flame comprises producing a flame with a secondary fuel having a water content greater than or equal to 20% by weight and less than or equal to 95% by weight.

37. The process as claimed in claim 2, wherein the step of producing a flame comprises producing a flame with a secondary fuel containing ash in proportions greater than 20% by weight.

38. The process as claimed in claim 2, wherein the step of preheating the second fuel comprises flowing the second fuel along an ignition distance between a point selected from the group consisting of the point of injection of the oxidizer and the point of injection of the fuel, and the beginning of the secondary flame, the distance being less than 2 meters.

39. The process as claimed in claim 2, wherein the step of preheating the second fuel comprises preheating a secondary fuel comprising several secondary fuels and containing 0% to 50% by volume of fuel identical to the primary fuel.

40. The process as claimed in claim 2, wherein the step of producing a flame comprises producing flame with primary fuel comprising from 0% to 100% by volume of fuel used as secondary fuel.

41. The process as claimed in claim 2, wherein the step of producing a flame comprises producing a flame with a secondary combustion zone which starts at a distance from the points of injection of the oxidizers and fuels such that 90% by volume of the primary oxidizer has reacted with the primary fuel.

42. The process as claimed in claim 2, wherein the energy of the primary flame is more than 30% of the total energy provided by the flame.

43. The process as claimed in claim 2, wherein the energy of the primary flame represents between 1% and 10% of the total energy provided by the flame.

44. The process as claimed in claim 2, wherein the primary fuel comprises natural gases.

45. The process as claimed in claim 2, wherein the primary oxidizer comprises oxygen-enriched air having more that 21% oxygen by volume.

46. The process as claimed in claim 2, wherein the secondary oxidizer consists essentially of air.

47. The process as claimed in claim 2, wherein the primary oxidizer has an oxygen concentration greater than the oxygen concentration of the secondary oxidizer.

48. The process as claimed in claim 2, wherein the second fuel is injected at a velocity which does not exceed 50 meters/s.

49. A process for calcining an ore-based material, comprising the steps of:

producing a flame with at least one fuel and at least one oxidizer, the flame comprising a primary combustion zone formed by the combustion of a first fuel and a first oxidizer, the primary combustion zone located adjacent to the points of injection of the first oxidizer and of the first fuel, and a secondary combustion zone formed by the combustion of a second fuel and a second oxidizer, the secondary combustion zone located downstream of the primary zone;

preheating the second fuel by flowing the second fuel through the primary zone of the flame; and heating said material by contact with a heat source created by the flame;

wherein the step of producing a flame comprises producing a flame with a secondary fuel having a net calorific value (NCV) less than or equal to $15\times10^6$ J/kg.

50. A process for calcining an ore-based material, comprising the steps of:

producing a flame with at least one fuel and at least one oxidizer, the flame comprising a primary combustion zone formed by the combustion of a first fuel and a first oxidizer, the primary combustion zone located adjacent to the points of injection of the first oxidizer and of the first fuel, and a secondary combustion zone formed by the combustion of a second fuel and a second oxidizer, the secondary combustion zone located downstream of the primary zone;

preheating the second fuel by flowing the second fuel through the primary zone of the flame; and heating said material by contact with a heat source created by the flame;

wherein the step of producing a flame comprises producing a flame with a secondary combustion zone which starts at a distance from the points of injection of the oxidizers and fuels such that 90% by volume of the primary oxidizer has reacted with the primary fuel.

51. A process for calcining an ore-based material, comprising the steps of:

producing a flame with at least one fuel and at least one oxidizer, the flame comprising a primary combustion zone formed by the combustion of a first fuel and a first oxidizer, the primary combustion zone located adjacent to the points of injection of the first oxidizer and of the first fuel, and a secondary combustion zone formed by the combustion of a second fuel and a second oxidizer, the secondary combustion zone located downstream of the primary zone;

preheating the second fuel by flowing the second fuel through the primary zone of the flame; and heating said material by contact with a heat source created by the flame;

wherein the primary oxidizer has an oxygen concentration greater than the oxygen concentration of the secondary oxidizer.

52. A process for calcining an ore-base material, comprising the steps of:

producing a flame with at least one fuel and at least one oxidizer, the flame comprising a primary combustion zone formed by the combustion of a first fuel and a first oxidizer, the primary combustion zone located adjacent to the points of injection of the first oxidizer and of the first fuel, and a secondary combustion zone formed by the combustion of a second fuel and a second oxidizer, the secondary combustion zone located downstream of the primary zone;

preheating the second fuel by flowing the second fuel through the primary zone of the flame; and heating said material by contact with a heat source created by the flame;

wherein the second fuel is injected at a velocity which does not exceed 50 meters/s.

53. The process as claimed in claim 52, wherein the second fuel is injected at a velocity which does not exceed 20 meters/s.

54. The process as claimed in claim 53, wherein the second fuel is injected at a velocity which is about 10 meters/s.

* * * * *